United States Patent [19]

Morgan

[11] Patent Number: 4,928,350

[45] Date of Patent: May 29, 1990

[54] MULTIPLE AXIS HIDDEN HINGE

[76] Inventor: James C. Morgan, 2922 Vancouver Dr., Little Rock, Ark. 72204

[21] Appl. No.: 385,701

[22] Filed: Jul. 27, 1989

Related U.S. Application Data

[63] Continuation-in-part of Ser. No. 229,437, Apr. 7, 1988, abandoned, which is a continuation-in-part of Ser. No. 59,430, Jun. 8, 1987, abandoned.

[51] Int. Cl.[5] ..... E05F 1/10

[52] U.S. Cl. ..... 16/297; 16/302; 16/307; 16/337; 16/348; 16/360; 16/371; 16/376; 16/379; 16/307

[58] Field of Search ..... 16/282, 285, 294, 295, 16/296, 297, 302, 307, 337, 346, 348, 357, 360, 361, 366, 371, 374, 376, 378, 379; 49/398, 399; 108/65, 69, 77

[56] References Cited

U.S. PATENT DOCUMENTS 429,391 6/1890 Slane ..... 16/366

FOREIGN PATENT DOCUMENTS 3023637 1/1981 Fed. Rep. of Germany ..... 16/337
188989 4/1964 Sweden ..... 16/361
2033956 5/1980 United Kingdom ..... 16/371

*Primary Examiner*—Nicholas P. Godici
*Assistant Examiner*—Edward A. Brown
*Attorney, Agent, or Firm*—Sutherland, Asbill & Brennan

[57] ABSTRACT

The present invention provides a hinge construction of two mounting plates and a substantially U-shaped center link which connects the axes of pivot of the two plates. The link and plates contain stop mechanisms which determine their respective limits of pivot. In addition, the hinge contains a means for restraining the rotation of only one of the mounting plates around its corresponding link arm to insure a pattern of motion that is always consistent, and allows for the hinge to be mounted with a very narrow gap between the members being joined. The hinge of the present invention can be variably constructed to conform to a number of alternative uses.

42 Claims, 5 Drawing Sheets

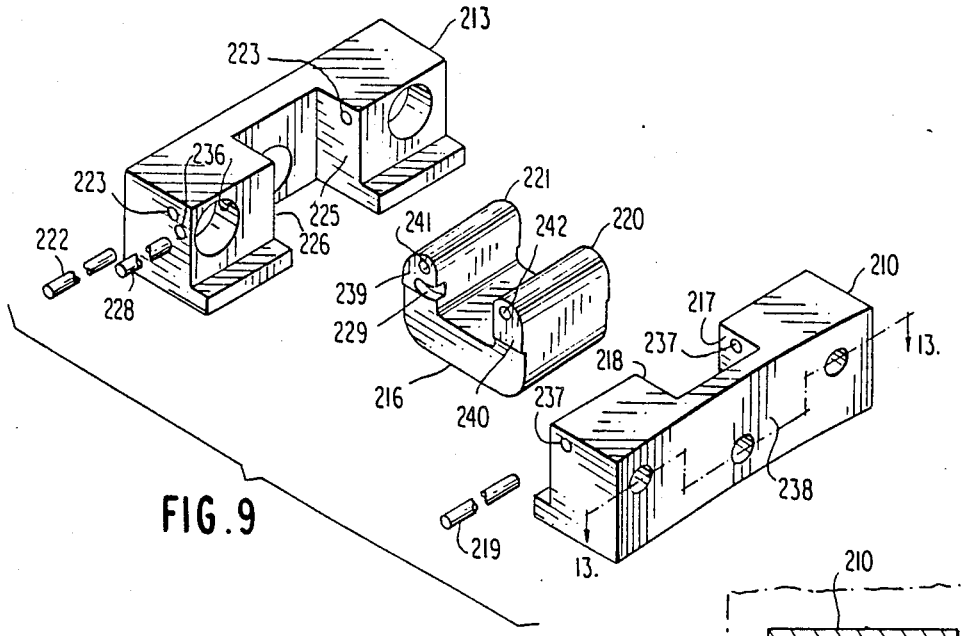
FIG. 9
FIG. 10
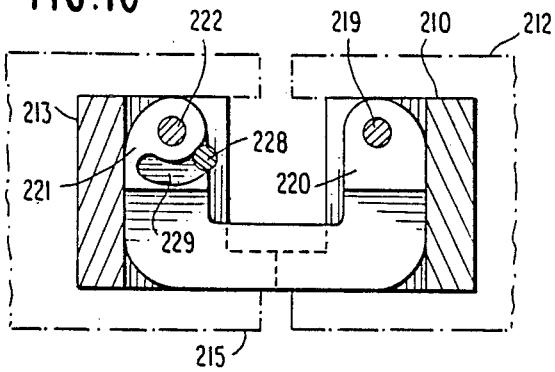
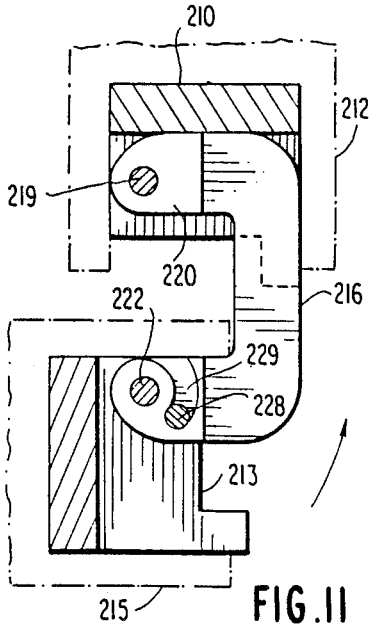
FIG. 11
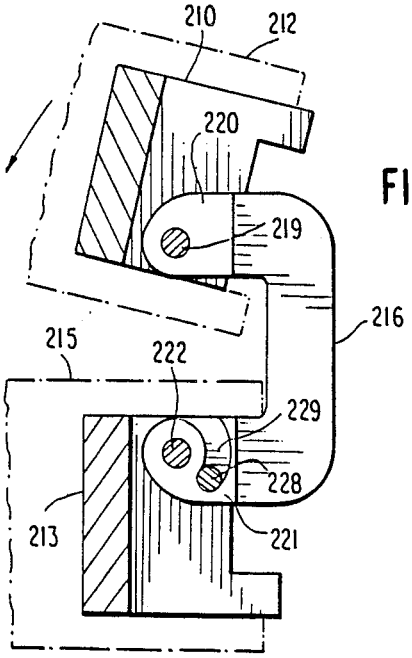
FIG. 12
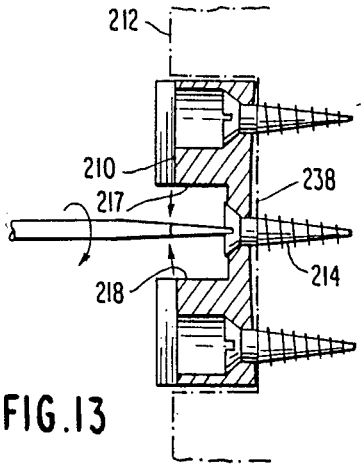
FIG. 13

MULTIPLE AXIS HIDDEN HINGE

This application is a continuation-in-part of application Ser. No. 229,437, Filed Apr. 7, 1988, now abandoned, which, in turn, is a continuation-in-part of application Ser. No. 59,430, filed Jun. 8, 1987, now abandoned.

This invention concerns a hinge, suitable for use in a variety of applications. The design and construction of the hinge allow it to join two members, while being itself completely hidden, and permit a very close fit between the members when in its initial position. When the hinge is folded open, its exposed portions provide an unobtrusive and aesthetically pleasing design.

In one of its embodiments, the hinge can be used in a folding table and leaf arrangement. The hinge is constructed to be exceptionally strong, to support weight placed on the extended leaf of the table. In the extended position, the hinge is completely invisible and thus provides an unbroken table-top surface.

The hinge may also be modified for use in a variety of cabinet doors. These embodiments are of light construction, but retain all the durability and features of the table hinge.

BACKGROUND OF THE INVENTION

The present invention belongs to the family of hinges used to join two members, of wood or a honeycomb material for example, in a variety of applications. More particularly, this invention relates to hidden hinges having multiple pivotal axes.

The original concept of a folding hinge is by no means a new one. Many varieties of such devices exist and are common knowledge to the general public.

There are also numerous hinges that pivot around more than a single axis, pivot through an arc of at least 180°, or may be constructed so as to be hidden in some position. The present invention, however, provides a hinge capable of performing all of these functions in a practical and aesthetic manner, not found in previous hinges.

U.S. Pat. No. 2,236,400, issued to Follmer, discloses a hinge with two axes of pivot. The hinge is completely visible, however, when it is mounted in the face of the table-top it is designed for use with.

U.S. Pat. No. 1,735,696, issued to Ridley, discloses a hidden hinge, that makes use of a link to join its two axes of pivot. The patent discloses no means to insure that the members in which the hinge is mounted will not contact one another and bind the hinge's motion.

The hinges of the prior art suffer from the fact that they cannot be truly hidden, and still perform their intended function, without risking damage to the members in which they are mounted. In order to assure that these hinges can pivot without causing the edges of the members to come into contact and bind, there must be a sizable gap between the members, and that makes the connecting link visible. In addition, the hinges of the prior art have an even greater tendency to bind if the direction of motion is changed part way through the hinge's rotation.

It would be advantageous to provide a hinge which could be completely hidden in its initial position, and yet allow the members it joins to move in a smooth and reliable manner, regardless of the direction of motion, while being unobtrusive and aesthetically pleasing in its folded position.

It is the object of the present invention to provide a hinge that will be truly hidden in its initial position.

A further object is to provide a hinge which will facilitate a fit between the joined members that is so close as to be virtually unbroken, i.e. with only a very narrow gap between the members.

A further object is to provide a hinge which can pivot through its arc of travel in one easy, smooth motion, and not bind or allow the edges of the members to come into contact with one another and be damaged.

A further object is to provide a hinge which will be unobtrusive and aesthetically pleasing when folded completely open.

Other objects and advantages of the present invention will be apparent to those skilled in the art.

BRIEF DESCRIPTION OF THE DRAWINGS

FIG. 9 is an isometric view of a third embodiment hinge in its disassembled state.

FIG. 10 is an enlarged cross-sectional view of the hinge depicted in FIG. 9, assembled and in the leaf-extended position, with the table top and leaf shown by broken lines.

FIG. 11 shows the same hinge as in FIG. 10, but with the leaf folded halfway back.

FIG. 12 shows the same hinge as in FIG. 10, but with the table leaf nearly completely inverted.

FIG. 13 is a cross-sectional view, taken along the line 11—11 in FIG. 9, but also showing mounting screws and, in broken lines, the leaf to which the mounting plate is attached.

SUMMARY OF THE INVENTION

Figure 1:
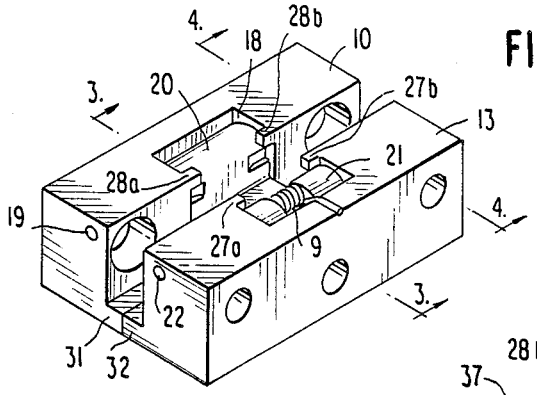
FIG. 1 is an isometric view of the assembled hinge of the first embodiment.
Figure 2:
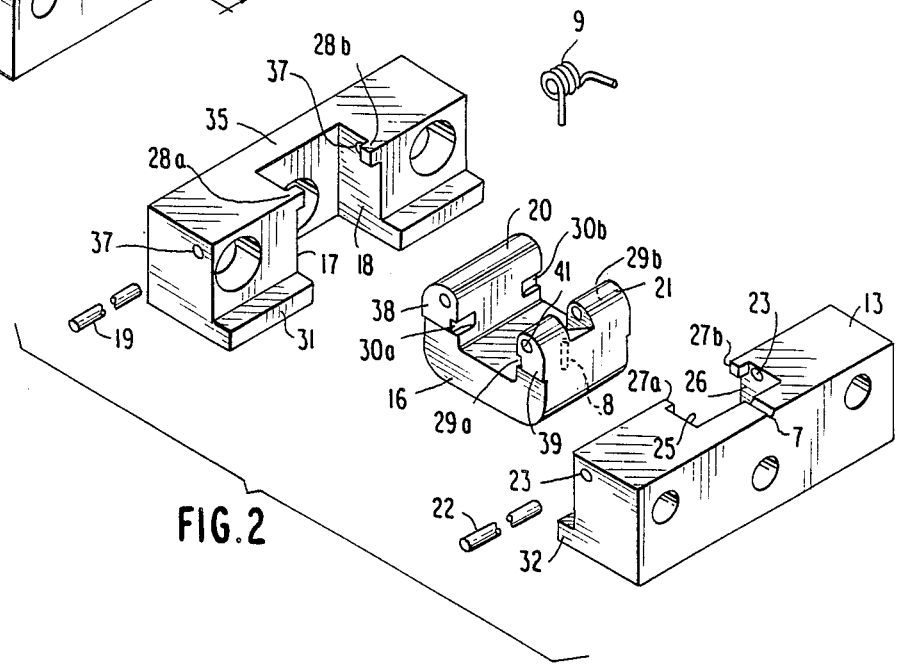
FIG. 2 is an isometric view of the same hinge as in FIG. 1, but disassembled.

The present invention provides a hinge constructed of two mounting plates and a substantially U-shaped center link which connects the axes of pivot of the two plates. The link and plates contain stop mechanisms which determine their respective limits of pivot. In addition, the hinge contains a means for restraining the rotation of only one of the mounting plates around its corresponding link arm to insure a pattern of motion that is always consistent, and allows for the hinge to be mounted with a very narrow gap between the members being joined. The hinge of the present invention can be variably constructed to conform to a number of alternative uses.

DETAILED DESCRIPTION

Table Hinge

The first embodiment of this invention concerns a hinge for a fold-up table leaf. More particularly, it relates to a hinge that provides strong horizontal support for the extended leaf, without being visible. Also, the hinge permits a very close fit between the stationary table top and the leaf when in the extended position.

Fold-up table leaves that are unsupported by a leg when placed in the extended position are found in a variety of applications, including passenger vehicles and hotel rooms. In executive jet aircraft, for instance, built-in card tables often are equipped with fold-up leaves to permit easier access to the seats at the table. The hinges for these table leaves have to be exceptionally strong, in order to support any weight placed on the extended leaf. Also, it is desirable that the hinges not interrupt the top surface of the table when in the extended position, in other words, that the hinges be invisible when the leaf is down. This is for both practical and aesthetic reasons.

The hinge of the present invention satisfies both of these objectives. It is comprised of a mounting plate that attaches to the edge of a stationary table top, a substantially U-shaped link that is pivotally attached near the end of one of its arms to the mounting plate, and another mounting plate that is pivotally attached to the second arm of the link, and to which plate the fold-up leaf is attached.

For purposes of the following discussion, the two mounting plates will be referred to as a "first" mounting plate and a "second" mounting plate. It should be understood, however, that either plate can be mounted to the table top or to the fold-up leaf.

Each mounting plate has a front surface and a rear surface. The rear surface is the surface that faces the edge of the table top or leaf when the hinge is mounted. The front surface of each mounting plate includes a pair of bracket members. The U-shaped link has a base and two substantially parallel arms. In one embodiment each of the arms of the link is pivotally attached near its end to one of the pairs of these bracket members. Each arm of the link preferably is thick enough (measured in the direction perpendicular to the U-shaped plane of the link) that it touches both of the bracket members to which it is attached. The axis of rotation of the attachment between each mounting plate and the arm of the link preferably will be substantially parallel to that plate's rear surface and perpendicular to the U-shaped plane of the link. The hinge is constructed so that the link and the first mounting plate are pivotable between a first limit, in which the arms of the link are substantially parallel to the rear surface of the first mounting plate, and a second limit that is at least about 90° of arc away from the first limit.

Similarly, the axis of rotation of the attachment of the second link arm to the bracket members of the second plate preferably is substantially parallel to that plate's rear surface and perpendicular to the U-shaped plane of the link. The construction of the hinge is such that the link and second plate are pivotable between a first limit, in which the plate's rear surface preferably is substantially parallel to the arms of the link, and a second limit that is approximately 90° of arc away from the first limit.

When both mounting plates and the link are at their first limits of pivot, the table leaf will be in the extended (i.e., unfolded or "down") position. When both plates and the link are at their second limits of pivot, the table leaf will be in the folded (i.e., inverted or "up") position.

The hinge will include means for increasing the inertial resistance between the first mounting plate and the U-shaped link, so as to partially restrain the link and the first mounting plate from being swung apart when they are at their first limit of pivot. The hinge includes no such means, however, between the link and the second mounting plate. In other words, the second mounting plate and the link are able to freely swing away from their first limit of pivot, but the first mounting plate and the link resist swinging apart when at their first limit of pivot. In this way, when the table leaf is in the extended position and force is applied to fold it up, that force will first cause the link and second plate to swing apart by approximately 90° (so that the leaf is standing straight up) and then, after that motion is completed, will cause the link and first mounting plate to swing apart until the inverted leaf comes to rest on top of the table. This partial restraining feature assures that the leaf will swing wide and not hit the table top.

Normally, a pair of hinges will be used. The first mounting plate, with the preferred restraining feature (what we might call the "tight" plate), can be attached either to the table or to the leaf. Both hinges must be mounted the same way, however. In other words, the tight plates of both hinges must be aligned on the same side, either both attached to the table top or attached to the fold-up leaf.

To provide the first limit of pivot between the first mounting plate and the link, it is preferred that the plate and link be so dimensioned that the first arm of the link abuts the front surface of the first plate when the plate and link are at their first limit of pivot. This abutment halts further movement between the first plate and the link.

To provide the first limit of pivot between the link and the second mounting plate, it is preferred that the front surface of at least one of the two mounting plates include a protruding stop member that abuts the front surface of the other mounting plate when the link and the two mounting plates are at their first limits of pivot, i.e., in the leaf extended position. Ideally, the front surface of each of the two mounting plates will include a protruding stop member and those members will be so positioned that they abut one another when the link and the two plates are at their lower limits of pivot. It is preferred that these protruding stop members be located low on the mounting plates, i.e., near the base of the link when in the leaf extended position.

The first limit of pivot between the second mounting plate and the link can be provided by so dimensioning those parts that the second arm of the link abuts the front surface of the second plate when the plate and link are at their first limit of pivot, e.g., when the leaf is fully extended. This abutment feature may be used in addition to, or in place of, the use of one or two protruding stop members.

The second limit of pivot between the second mounting plate and the link preferably is provided by the combination of (a) a protruding member carried either by one of the brackets of the plate or by the second link arm and (b) a corresponding recess in the surface of the attached bracket or link arm, in which recess the protruding member rides when the link and second plate are pivoted. The recess must have an end wall which the protruding member abuts when the second mounting plate reaches its second limit of pivot. The protruding member can be provided by a variety of elements, for example either a removable pin or a lug that is integral with the bracket or link. I have found more strength to be provided by a lug that is integral with one of the brackets on the mounting plate. An optional, additional pin or lug can be used on the other bracket for further increased strength.

The hinge may optionally also include means for providing a second limit of pivot between the link and the first mounting plate that is approximately 90° to 100° of arc away from the first limit of pivot for those two parts. The same combination of a protruding member (carried either by one of the brackets or by the first link arm) and a corresponding recess in the surface of the bracket or link arm may be used to provide this second limit of pivot.

Each of the two mounting plates in the hinge of this invention preferably contains at least one screw hole located on each side of the link. These are for mounting the hinge. The axes of the screw holes should be substantially perpendicular to the plate's rear surface.

The preferred means of partially restraining the link and the first mounting plate from swinging apart when they are at their first limit of pivot is provided by a coil spring mounted on the axis of the first link arm, one end of the coil exerting torque on the mounting plate, the other end of the coil exerting an opposite torque on the link arm, urging the plate and the link toward their first limit of pivot.

In the preferred embodiment, one end of the coil lies in a notch cut in the first mounting plate, preferably near the center of the plate. The opposite end of the coil spring is inserted into a hole in the first link arm.

Use of the resistance spring provides inertial resistance to the motion of the link arm and first mounting plate from their first limit of pivot. That resistance can be overcome by manual force, however, and the first plate and arm moved to their second limit of pivot. Once at their second limit of pivot, the weight of the table leaf will be adequate to prevent the spring from automatically returning the plate and arm to their first limit of pivot; it will require manual force to do so. The spring insures that the first pivoting motion will always be at the second mounting plate; when the extended table leaf is folded up and when the folded-up leaf is swung down, the first pivoting motion will be at the first mounting plate. This order will be the same regardless of whether the "tight" side of the hinge is mounted to the table top or to the leaf. This order of hinge motion insures that the edges of the table, and of the leaf, will never come into contact with one another or bind in any way, even if the direction of motion is abruptly changed while the leaf is being swung up or swung down.

Another method of partially restraining the link and the first mounting plate from swinging apart when they are at their first limit of pivot is provided by the distance between the bracket members on the first mounting plate being made slightly less than the thickness of the first link arm, so that, in order to assemble the hinge, the link arm must be forced into the space between the brackets. This will cause the brackets to exert a constant clamping pressure against the link. After numerous cycles of use, the pressure exerted by the brackets against the link naturally will lessen. In this embodiment of the present invention, however, the following means can be provided for restoring the original tight fit.

The rear surface of the first mounting plate may be made so that it is slightly bowed inward. This is with reference to the direction parallel to the axis of rotation of the link. When the first plate is mounted to the straight edge of the table top or leaf, a shim may be placed behind the plate, centered between the two bracket members, in order to cause the plate to bow a little bit more when the mounting screws are tightened. The shim should not be so thick, however, as to cause all of the clamping pressure against the first arm of the link to be released. Later, when the joint has worn loose, the shim may be removed, thereby restoring the clamping pressure.

Preferably, a third screw hole will be provided in the first mounting plate, between the two bracket members. If the joint becomes loose a second time, a screw can be inserted in that middle hole to draw the center of the plate back further, until it is flush against the table or leaf edge. This will slightly bend the brackets toward one another, and once again restore the clamping pressure against the first arm of the link.

Obviously, in the preferred embodiment incorporating the coil spring, the first mounting plate need not be bowed, but a third screw hole may still be provided for additional mounting strength.

The hinge of the present invention is designed to be mounted in routed-out recesses in the edges of the table top and leaf. The recesses need not break through either the top or bottom surfaces of the table top or leaf. When the leaf is extended, this gives both of those surfaces a smooth appearance, interrupted only by a narrow, even gap between the table top and the leaf. The hinge is invisible, folded away inside the recesses, or pockets, in the two opposed edges. The structure of the hinge allows the leaf to be mounted so close to the table top that, in the extended position, the top and the leaf present a continuous writing surface.

The U-shaped design of the center link gives the hinge of the present invention a nice smooth appearance when it is in the folded-up position. Steel hinges of the prior art, lacking such an appearance, often have had to be plated with brass, chromium, gold, or silver to satisfy aesthetic demands.

If desired, however, the hinge of the present invention also can be metal plated. To facilitate the plating operation, it is preferred that the portions of each arm of the link that ride against the adjacent bracket members be raised land areas, machined to the desired finished tolerance. The height of the rise should be at least as great as the intended thickness of the plating. In this manner, the land areas can be chemically or physically masked during the plating operation, to prevent the link from becoming thicker in that area. Most, if not all, of the land area will be hidden from view in the assembled hinge, so the fact that it is not plated will not be noticeable.

Cabinet Hinge

Other embodiments of the present invention are intended for use with door and stile assemblages, useful for mounting cabinet doors. These embodiments are of lighter weight construction, but contain essentially the same features of the table leaf hinge. The cabinet versions allow a door either to be flush-mounted, so as to be coplanar with the stile when the door is closed, or mounted perpendicular to the stile. The "flush-mount" hinge contains mounting plates that are directly analogous to the table leaf hinge mounting plates. In the "90°" version, however, one of the mounting plates is designed to allow the hinge to be most easily and securely mounted to provide a 90° angle between the plane of the stile and the plane of the flat surface of the door, when the door is in the closed position. Both the flush-mount and 90° hinges will be described in further detail below.

In general, the cabinet hinge is comprised of a mounting plate that attaches to the edge of a stationary stile upon which a cabinet door is to be mounted, a substantially U-shaped link that is pivotally attached near the end of one of its arms to the mounting plate, and another mounting plate that is pivotally attached to the opposite arm of the link, and to which plate the cabinet door is attached.

For purposes of the following discussion, the two mounting plates will be referred to as a "first" mounting plate and a "second" mounting plate. The first mounting plates of both the flush-mount and 90° versions are essentially the same. The flush-mount hinge has a second mounting plate which is substantially similar to the first. In the 90° version, however, the second mounting plate is different from the first. It should be understood that for the flush-mount hinge, either plate can be mounted to the stile or to the door. In the 90° hinge, it is preferred that the second mounting plate be mounted in the stile.

Each mounting plate of the flush-mount hinge has a front surface and a rear surface. The rear surface is the surface that faces the edge of the stile or door when the hinge is mounted. In the 90° hinge, however, the front and rear surfaces of the second mounting plate are substantially perpendicular to the edge of the stile. For both versions, the front surface of each mounting plate includes a pair of bracket members. The U-shaped link has a base and two substantially parallel arms. Each of the arms of the link is pivotally attached near its end to one of the pairs of these bracket members. Each arm of the link preferably is thick enough (measured in the direction perpendicular to the U-shaped plane of the link) that it touches both of the bracket members to which it is attached. The axis of rotation of the attachment between each mounting plate and the arm of the link preferably is substantially parallel to that plate's rear surface and perpendicular to the U-shaped plane of the link. The hinge is constructed so that the link and the first mounting plate are pivotable between a first limit, in which the arms of the link are substantially parallel to the rear surface of the first mounting plate, and a second limit that is at least about 90° of arc away from the first limit.

Similarly, the axis of rotation of the attachment of the second link arm to the bracket members of the second plate preferably is substantially parallel to that plate's rear surface and perpendicular to the U-shaped plane of the link. The construction of the hinge is such that the link and second plate are pivotable between a first limit, in which the plate's rear surface is substantially parallel to the arms of the link, and a second limit that is approximately 90° of arc away from the first limit.

When both mounting plates and the link are at their first limits of pivot, the cabinet door will be in its closed position. When both plates and the link are at their second limits of pivot, the door will be open, and folded back approximately 180°.

The hinge will include means for increasing the inertial resistance between the first mounting plate and the U-shaped link, so as to partially restrain the link and the first mounting plate from being swung apart when they are at their first limit of pivot. The hinge includes no such means, however, between the link and the second mounting plate. In other words, the second mounting plate and the link are able to freely swing away from their first limit of pivot, but the first mounting plate and the link resist swinging apart when at their first limit of pivot. In this way, when the door is closed and force is applied to open it, that force will first cause the link and second plate to swing apart by approximately 90° (so that the flat plane of the door is perpendicular to the stile in the flush-mount version, or parallel to the stile in the 90° hinge) and then, after that motion is completed, will cause the link and first mounting plate to swing apart until the door is swung completely open. This partial restraining feature assures that the door will swing wide and not hit the edge of the stile.

Normally, a pair of hinges will be used. In the flush-mount hinge, the first mounting plate, with the preferred restraining feature (what we might call the "tight" plate), can be attached either to the door or to the stile. Both hinges must be mounted the same way. In other words, the tight plates of both hinges must be aligned on the same side, either both attached to the door or both attached to the stationary stile. In using the 90° hinge it is preferred that the tight plate be mounted in the door and the second plate be mounted in the stile. Again, both hinges must be mounted with the same orientation.

The limits of pivot are provided for in the same manner for the flush-mount and 90° hinges. To provide the first limit of pivot between the first mounting plate and the link, it is preferred that the plate and link be so dimensioned that the first arm of the link abuts the front surface of the first plate when the plate and link are at their first limit of pivot. This abutment halts further movement between the first plate and the link.

The first limit of pivot between the second mounting plate and the link also can be provided by so dimensioning those parts that the second arm of the link abuts the front surface of the second plate when the plate and link are at their first limit pivot, e.g., when the door is closed.

The second limit of pivot between the second mounting plate and the link preferably is provided by the combination of (a) a protruding member carried by one of the brackets of the plate and (b) a corresponding recess in the surface of the link arm, in which recess the protruding member rides when the link and second plate are pivoted. The recess must have an end wall which the protruding member abuts when the second mounting plate reaches its second limit of pivot. The protruding member can be provided by a variety of elements, for example either a removable pin or a lug that is integral with the bracket or link. I have found more strength to be provided by a lug that is integral with one of the brackets on the mounting plate. An optional, additional pin or lug can be used on the other bracket for further increased strength.

The hinge may optionally also include means for providing a second limit of pivot between the link and the first mounting plate that is approximately 90° to 100° of arc away from the first limit of pivot for those two parts. The same combination of a protruding member carried by one of the brackets and a corresponding recess in the surface of the link arm may be used to provide this second limit of pivot.

Each of the two mounting plates in the flush-mount embodiment of this invention preferably contains at least one screw hole located on each side of the link. These are for mounting the hinge. The axes of the screw holes should be substantially perpendicular to the plate's rear surface. Each of the plates of the flush-mount hinge, and the first plate of the 90° hinge, preferably contain similar screw holes. These plates are preferably mounted by being screwed directly into the edge of the member to which the plate is to be attached. The second plate of the 90° hinge must be mounted differently in order to more easily achieve the right-angle orientation of the door mount.

The second mounting plate of the 90° hinge preferably contains a female-threaded screw hole and a smooth pin hole. These holes are preferably located side-by-side on the plate, and at a lower level than the level of the base of the link arm when the plate is at its first limit of pivot. In this embodiment, the second mounting plate is mated to an extension mount which may be held (for example by glue) in a routed-out pocket in the edge of the stationary stile. The plate preferably is attached to the extension mount through the use of a machine screw screwed into the plate's threaded hole. The plate's smooth hole is fitted over a pin on the extension mount to keep the hinge from rotating around the axis of the mounting screw. When mounted, the hinge joins the stile and door so as to form a 90° angle between the plane of the stile and the plane of the flat surface of the cabinet door, when the door is in the closed position. This hinge can be mounted so as to allow the door to swing in either direction (i.e., left or right, relative to the stile). Other methods of joining the second plate to the extension mount, and a variety of such mounts, will be apparent to those skilled in the art of door-stile arrangements.

The preferred means of partially restraining the link and the first mounting plate from swinging apart when they are at their first limit of pivot is the same for all versions of the hinge of the present invention—namely, the aforementioned coil spring mounted on the axis of the first link arm, one end of the spring exerting torque on the mounting plate, the other end of the spring exerting an opposite torque on the link arm, urging the link and the plate toward their first limit of pivot.

The cabinet hinges of the present invention are designed to be mounted in routed-out recesses in the edges of the stile and door. The recesses need not break through either the top or bottom surfaces of the stile or door. When the door is closed, this gives both of those surfaces a smooth appearance, interrupted only by a narrow, even gap between the stile and the door. The hinge is invisible, folded away inside the recesses, or pockets, in the two opposed edges.

The U-shaped design of the center link is the same in the cabinet version as in the table-leaf version and gives the hinge the same smooth appearance when it is in the folded-open position. Again, to facilitate plating of the hinge, it is preferred that the portions of each arm of the link that ride against the adjacent bracket members be raised land areas, machined to the desired finished tolerance, the height of the rise being at least as great as the intended thickness of the plating.

Figure 7:
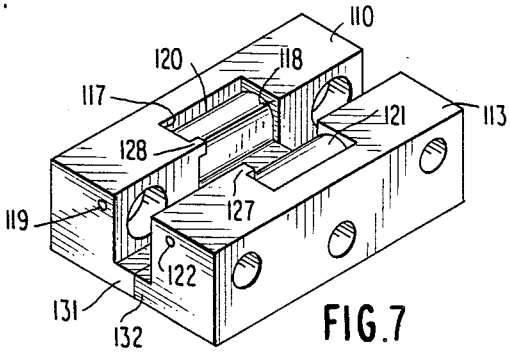
FIG. 7 is an isometric view of the assembled hinge of the second embodiment.
Figure 8:
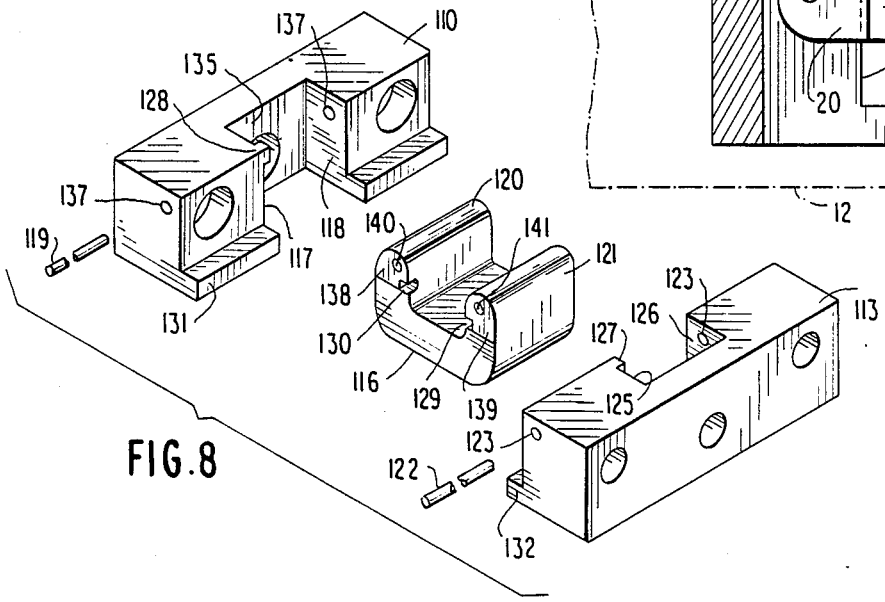
FIG. 8 is an isometric view of the second embodiment hinge in its disassembled state.

This invention will be better understood in all its described embodiments by studying the drawings accompanying this specification. Referring to the drawings, FIGS. 1–6 depict one embodiment of the table leaf hinge of the present invention, FIGS. 7 and 8 depict a second embodiment having an alternate restraining means, and FIGS. 9–13 depict a slightly different third embodiment of the table hinge. FIGS. 14–17 depict the first embodiment or flush-mount version of the cabinet hinge, and FIGS. 18–24 depict the 90° angle cabinet hinge and details of its mounting.

In the hinge of FIGS. 1–6 first or "fixed" mounting plate 10 is attached by screws 11 to stationary table top 12. Second or "pivoting" mounting plate 13 is attached by screws 14 to fold-up table leaf 15. Left arm 20 of U-shaped link 16 is attached to bracket members 17 and 18 of the fixed mounting plate 10 by pivot pin 19, which is mounted in hole 37. The distance between bracket members 17 and 18 is the same as the thickness of link arm 20. This prevents looseness in the hinge, but allows arm 20 to pivot freely about pivot pin 19, without any substantial interference from bracket members 17 and 18. Bracket members 25 and 26 of pivoting mounting plate 13 are attached to arm 21 of link 16 by pivot pin 22, which is mounted in hole 23. Brackets 25 and 26 carry lugs **27*a* and 27*b* that are integral with the mounting plate. Fixed mounting plate 10 similarly has lugs 28*a* and 28*b* protruding from brackets 17 and 18. The right arm 21 of link 16 is held in place by spring 9. One end of spring 9 is inserted in hole 8 in arm 21 of link 16. The opposite end of spring 9 rides in notch 7 in mounting plate 13**.

Figure 3:
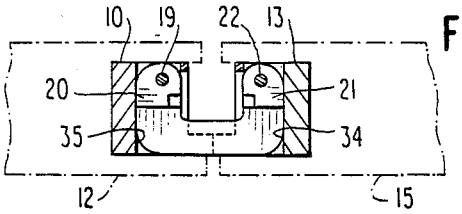
FIG. 3 is a cross-sectional view of the hinge depicted FIG. 1, taken along the line 3—3 in FIG. 1, but also showing with broken lines the outline of a table top and leaf to which the hinge is mounted.
Figure 5:
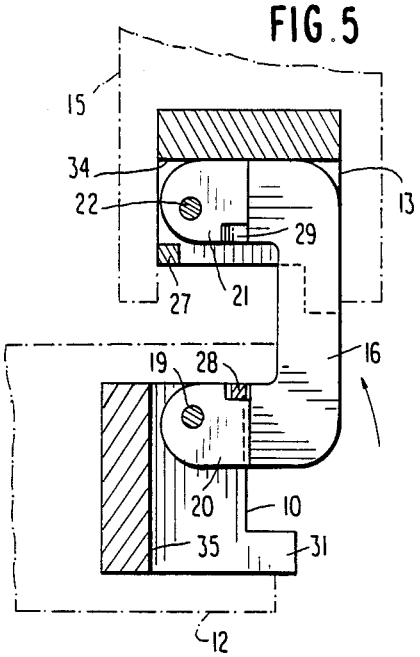
FIG. 5 is an enlarged view of the hinge as depicted in FIG. 3, but with the table leaf folded halfway back.
Figure 6:
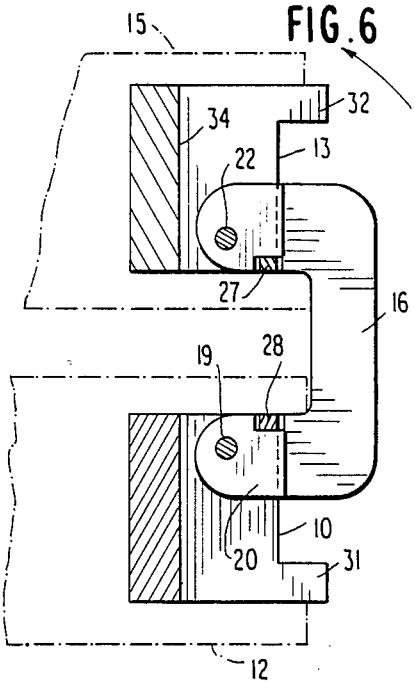
FIG. 6 depicts the same hinge as in FIG. 5, but with the table leaf completely inverted.

The action of the hinge during the folding up of table leaf 15 can be seen by comparing FIGS. 3, 5, and 6. As seen in FIG. 5, upward force on leaf 15 causes link 16 to pivot on pin 19 until recess **30*a* and 30*b* in arm 20 come to rest against lugs 28*a* and 28*b* of bracket member 17 and 18. In this position leaf 15 is pointing straight up. Additional counterclockwise force on leaf 15 causes the flexing of spring 9, thus permitting plate 13 to pivot around pin 22. As illustrated in FIG. 6, this motion of plate 13 continues until lugs 27*a* and 27*b* on brackets 25 and 26 abut against recess 29*a* and 29*b* in arm 21. By this time leaf 15 is fully inverted and is folded back over table top 12**.

Figure 4:
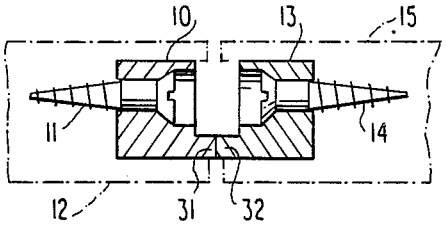
FIG. 4 depicts the same mounted hinge as FIG. 3, but in a cross-sectional view taken along the line 4—4 in FIG. 1.

As seen in FIGS. 1, 3, and 4, when leaf 15 is in its fully extended position, coplanar with table top 12, it is prevented from dropping below horizontal by the abutment of feet 31 and 32, respectively, of mounting plates 10 and 13. Also working to hold the leaf 15 level is the abutment of link arm 21 against front wall surface 34 that extends between brackets 25 and 26 of pivoting mounting plate 13. Similarly, link arm 20 comes to rest against front wall surface 35 of fixed mounting plate 10. Preferably, feet 31 and 32 will meet when leaf 15 is still slightly above horizontal, e.g., about 2° above. Then, when any substantial weight is rested on leaf 15, the leaf can bend slightly downward without dipping below horizontal.

Link 16 has raised land areas 38 and 39 around its pivot pin holes 40 and 41. Although barely perceptible in the drawings, that feature is repeated on the opposite side of the link.

FIGS. 7 and 8 represent the second embodiment of the table leaf hinge. In this embodiment, the resistance of the "tight" plate 113 of the hinge is provided by the pinching action of the brackets 125 and 126 on the arm 121 of the link 116. In this version of the hinge only single lugs 127 and 128 that are integral with brackets 117 and 125 on each side of the link arm are used. The use of a single lug on each bracket allows for a hinge to be created with less material and machining, for applications that do not require the strength provided by the extra lugs.

This embodiment, though having a different restraining means, in this case the pinching action of brackets 125 and 126, follows the motion of the preferred embodiment shown in the description of FIGS. 5 and 6 above. The difference in this second embodiment is that in order to move from the position shown in FIG. 5 to that shown in FIG. 6, the additional counterclockwise force is added to get brackets 125 and 126 to release arm 121 and allow plate 113 to rotate around pin 122.

In the hinge of FIGS. 9–13, fixed mounting plate 213 is equipped with a stop pin 228 mounted in hole 236 of bracket 226. Unlike the embodiment of FIGS. 1–6 or 7–8, in this version of the hinge no protrusion from bracket or link arm is used to establish a second limit of pivot for the pivoting mounting plate 210. Instead, its second limit of pivot (when unmounted) would be the position at which the two mounting plates would contact one another. In other words, it is not necessary that the second limit of pivot between the link and the first mounting plate in the hinge of this invention be precisely at or near 90° of arc away from the first limit of pivot. It is only necessary that it be at least about 90° of arc away.

Arm 220 of link 216 is attached to pivoting mounting plate 210 by pivot pin 219, which is mounted in hole 237 in brackets 217 and 218. Arm 221 of link 216 is attached to brackets 225 and 226 of fixed plate 213 by pivot pin 222, which is mounted in hole 223. Link 216 has raised land areas 239 and 240 around pivot pin holes 241 and 242. Corresponding land areas (barely perceptible in the drawings) are on the opposite side of link 216 as well.

Stop pin 228 protrudes from bracket 226 and rides in curved recess 229 in link arm 221. As seen in FIG. 11, as table leaf 212 is lifted, link 216 rotates counterclockwise about pivot pin 222 until the end wall of recess 229 in link arm 221 abuts against the protruding end of stop pin 228. Plate 210 is temporarily restrained from pivoting about pin 219 by the pinching action of brackets 217 and 218. As shown in FIG. 12, as more counterclockwise force is applied to leaf 212, the brackets 217 and 218 release arm 220 and allow plate 210 to rotate about pin 219 until leaf 212 comes to rest (not shown) against table top 215. As mentioned above, in this embodiment no protruding stop member is used with the pivoting mounting plate 210.

As can be seen in FIGS. 9 and 13, the rear surface 238 of fixed mounting plate 210 is slightly bowed or arched. If the clamping pressure against link arm 220 decreases over time to the point that the hinge no longer operates in the correct sequence—that is, link 215 pivots around pin 222 before mounting plate 210 pivots around pin 219—then the pressure can be increased by driving middle screw 214 further into the edge of table leaf 212. As shown in FIG. 13, this serves to draw brackets 217 and 218 closer together, and thus reestablish the clamping action against link arm 220.

FIGS. 14–17 depict the "flush-mount" cabinet door embodiment of the hinge of the present invention. These figures show the cabinet hinge in the same orientation as the hinge of the figures above, in order to more clearly show that the cabinet hinge contains the same features as the table leaf hinge. The cabinet door hinges will mount in a door and stile arrangement. This arrangement can be in any orientation of cabinet desired. For instance, a cabinet with a flush-mouthed door that opens vertically, or one that opens horizontally. The hinge and stile shown in FIGS. 14 and 15 lie flat so as to be in the same orientation as the figures showing the table leaf hinge.

Figure 14:
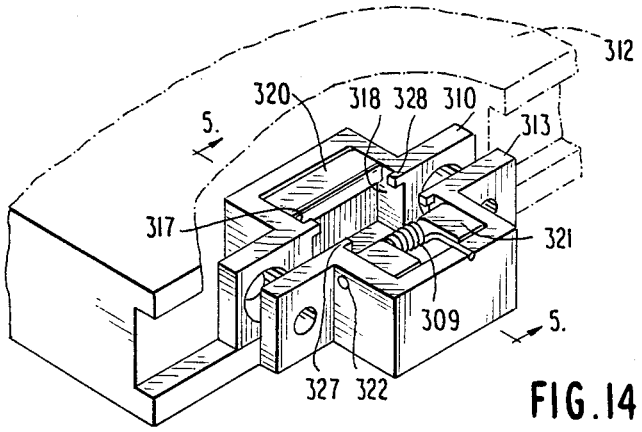
FIG. 14 is an isometric view of the assembled flush-mount hinge, showing in broken lines the outline of the member in which the loose plate is mounted.
Figure 15:
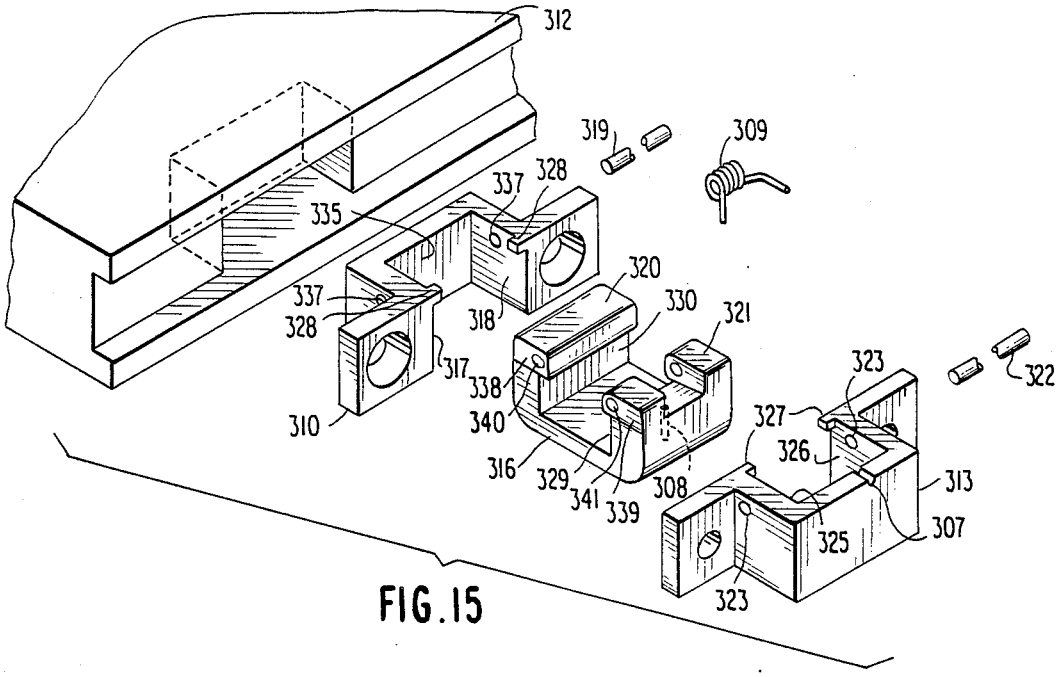
FIG. 15 is an isometric view of the same hinge as in FIG. 14, but disassembled.

In FIGS. 14 and 15, fixed mounting plate 310 is attached to stationary stile 312. Pivoting mounting plate 313 mounts in cabinet door 315. Left arm 320 of U-shaped link 316 is attached to bracket members 317 and 318 of fixed mounting plate 310 by pivot pin 319, which is mounted in holes 337 and 340. The distance between bracket members 317 and 318 is approximately the same as the thickness of link arm 320. This prevents looseness in the hinge, but allows arm 320 to pivot freely about pivot pin 319, without any substantial interference from bracket members 317 and 318. Bracket members 325 and 326 of pivoting mounting plate 313 are attached to arm 321 of link 316 by pivot pin 322, which is mounted in holes 323 and 341. Brackets 325 and 326 carry lugs 327 that are integral with the mounting plate. Fixed mounting plate 310 similarly has lugs 328 protruding from brackets 317 and 318. The right arm 321 of link 316 is held at its first limit of pivot by the resistance supplied by spring 309. One end of spring 309 is inserted in hole 308 in arm 321 of link 316. The opposite end of spring 309 rides in notch 307 in mounting plate 313.

Figure 16:
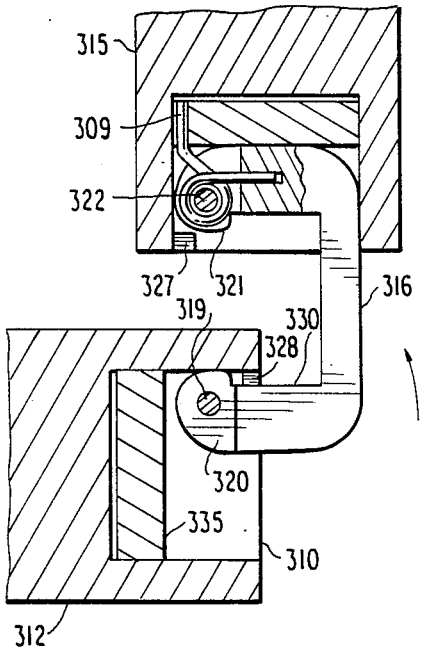
FIG. 16 is an enlarged, cross-sectional view of the mounted hinge of FIG. 14, taken along the line 5—5, with the door folded halfway open.
Figure 17:
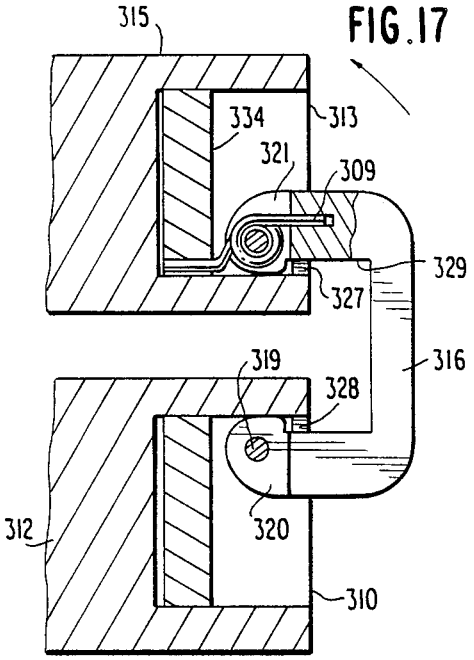
FIG. 17 depicts the same hinge as FIG. 16, but with the door folded completely open.

The action of the hinge during the opening of the cabinet door is the same as that of the table leaf hinge and can be seen by comparing FIGS. 14, 16, and 17. As seen in FIG. 16, a pulling force on door 315 causes link 316 to pivot on pin 319 until the front surface 330 of link arm 320 comes to rest against lugs 328 of bracket members 317 and 318. In this position door 315 is pointing straight out, perpendicular to stile 312. Additional counterclockwise force on door 315 causes the flexing of spring 309, thus permitting plate 313 to pivot around pin 322. As illustrated in FIG. 17, this motion of plate 313 continues until lugs 327 on brackets 325 and 326 abut against the front surface 329 of link arm 321. By this time the door 315 is completely folded back in front of stationary stile 312.

Link 316 has raised land areas 338 and 339 around its pivot pin holes 340 and 341. This feature is repeated on the opposite side of the link (not shown).

Figure 18:
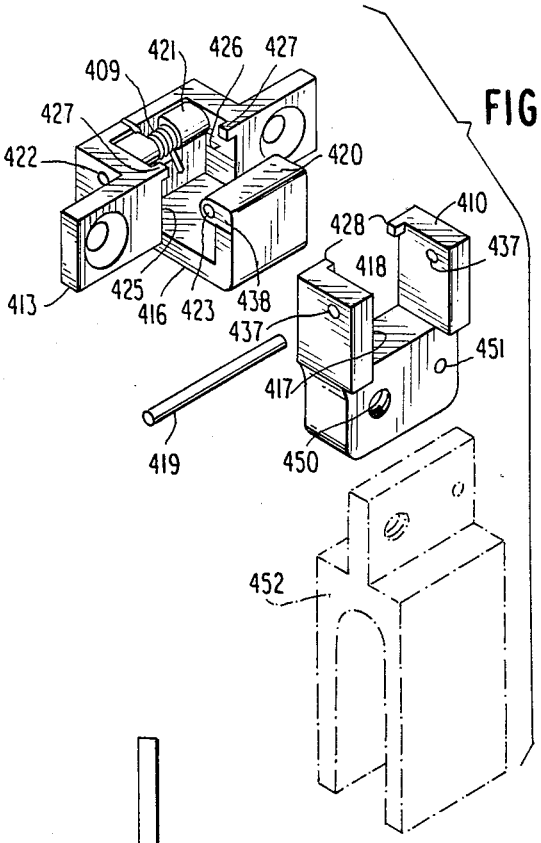
FIG. 18 is an isometric view of the 90° hinge, partly disassembled.

FIG. 18 shows a partly disassembled view of the 90° cabinet door hinge. This hinge contains the salient features of the hinge shown in FIG. 14 and follows an order of motion as is indicated in FIGS. 16 and 17. In FIG. 18, pivoting mounting plate 413 is essentially the same as fixed mounting plate 313 of FIG. 14. Left arm 421 of U-shaped link 416 is attached to bracket members 425 and 426 of pivoting mounting plate 413 by pivot pin 422, which is mounted in hole 423. Plate 413 has resistance supplied by spring 409 to hold link 420 against plate 413, i.e., at the first limit of pivot. Bracket members 425 and 426 contain lugs 427 which are integral with mounting plate 413. When pivoting plate 413 is at its second limit of pivot, lugs 427 of plate 413 abut against front surface of link arm 421.

Arm 420 of link 416 is attached to bracket members 417 and 418 of fixed mounting plate 410 by pivot pin 419, which is mounted in holes 437 and 423. The distance between bracket members 417 and 418 is the same as the thickness of link arm 420. This prevents looseness in the hinge, but allows arm 420 to pivot freely about pin 419, without any substantial interference from bracket members 417 and 418. Fixed mounting plate 410 similarly has lugs 428 protruding from bracket members 417 and 418, which are integral with plate 410. Fixed mounting plate 410 has screw hole 450 and pin hole 451 to enable mounting plate 410 to be attached to extension mount 452 (shown in broken lines).

Figure 23:
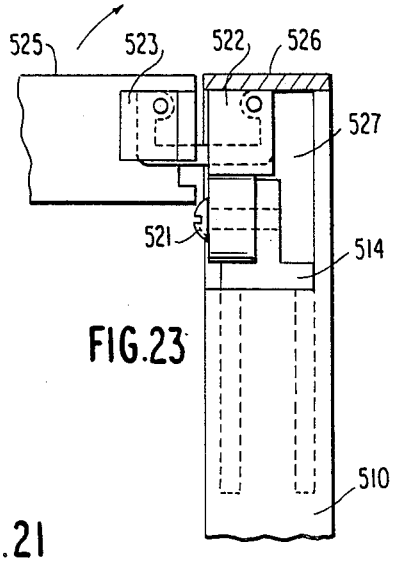
FIG. 23 shows the completed 90° hinge assembly.
Figure 24:
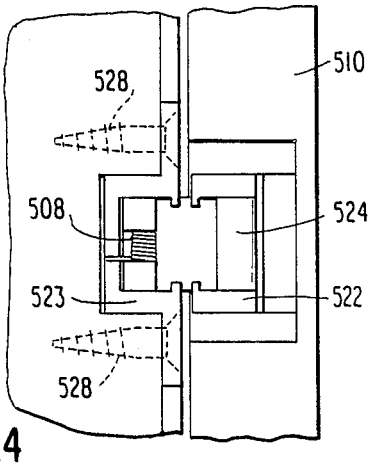
FIG. 24 shows an orthogonal view of the mounted hinge from the front, with the cap removed and the facing of the door "peeled back".

Reference now is made to FIGS. 19–24 which describe a method of mounting the 90° hinge of FIG. 18 in a stile and door arrangement in which the door, when closed, is perpendicular to the plane of the stile. FIGS. 19–23 depict a sequence of steps, illustrating the general mounting procedure. In order to see the hinge mount clearly, the view of these figures is oriented from above in a cross section of the door and stile. FIG. 24 is a view of the front of a cabinet door made of a honeycomb material, with part of the facing "peeled back" to show the mounted hinge.

Figure 19:
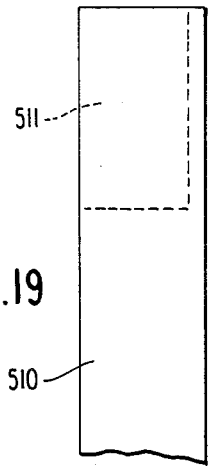
FIG. 19 shows the first step in the mounting process of the hinge of FIG. 18, which is a cross-sectional view of the stationary stile.

FIG. 19 shows stile 510, with the initial mounting area 511 that is to be routed out. The view is taken along a cross-section of the stile in order to show in solid lines what would be hidden within the stile if viewed from its top end.

Figure 20:
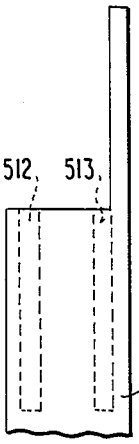
FIG. 20 depicts the stile of FIG. 19, but with the trenches cut for the mounting of an extension mount.

Once the initial mounting area 511 has been cut out, two narrow channels 512 and 513 are routed out deeper into the stile as shown in FIG. 20. Channel 512 and channel 513 are provided to hold the "legs" of extension mount 514.

Figure 21:
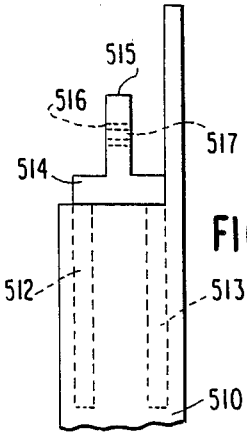
FIG. 21 shows the stile of FIG. 20 with the extension mount in place.

FIG. 21 shows extension mount 514 after it has been set in channels 512 and 513. Extension mount 514 is held in place by an adhesive, to form a strong bond with stile 510. Different adhesives may be used and may depend on the particular material of construction of the stile 510 and extension mount 514. Variations of materials and adhesives will be apparent to those skilled in the art of such mounting procedures. The cap 515 of extension mount 514 contains a pin hole 516, and a screw hole 517. These holes correspond to the mounting holes found in the second mounting plate of the 90° hinge.

Figure 22:
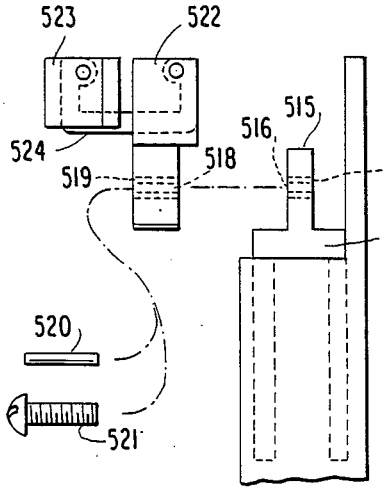
FIG. 22 is an exploded view of the stile with extension mount, hinge, and mounting screw and pin.

FIG. 22 shows a partially exploded view of the 90° hinge as it is mated to extension mount 514. The hinge's second mounting plate 522 also contains a pin hole 518 and a screw hole 519. The second mounting plate 522 is aligned with cap 515 of extension mount 514 and secured with a machine screw 521 through holes 517 and 519. A straight pin 520 is inserted through holes 516 and 518 in order to keep mounting plate 522 from pivoting around the axis of screw holes 517 and 519. Straight pin 520 should be tight fitting to insure that it does not fall out. FIG. 22 also shows that the second mounting plate 522 is attached to the hinge's first mounting plate 523 by U-shaped center link 524.

FIG. 23 shows the complete hinge assembly mount. Once second mounting plate 522 has been mated to extension mount 514, first mounting plate 523 can then be mounted to a door 525. First mounting plate 523 is mounted as are the mounting plates of the flush-mount version of the hinge. Space is routed out in the edge of door 525, and plate 523 is simply screwed in place with flat head wood screws. Once door 525 has been mounted, a cap 526 is affixed to the edge of stile 510 in order to hide mounting plate 522 and extension mount 514. Cap 526 may be affixed with a proper adhesive and is of such thickness as to provide a flush surface with the outer face of door 525. If desired, the resulting empty space 527 behind second mounting plate 522 can be filled with a plug before cap 526 is glued in place, in order to strengthen the mount and provide further support for cap 526. Finally, the arrow shows the direction of motion in which door 525 will travel when it is opened.

FIG. 24 shows the mounted hinge assembly from an angle facing the front of the mounted door, with cap 526 removed and the face of door 525 peeled back to expose first mounting plate 523. This view shows more clearly the mounting arrangement of first plate 523, using wood screws 528, and its connection to link 524 and second plate 522.

I claim:

1. A multiple axis hidden hinge suitable for joining a first member and a second member, said hinge comprising:

(a) a first mounting plate, said mounting plate including a pair of bracket members;

(b) a substantially U-shaped link having a base and two substantially parallel arms, the first arm of said link being pivotally attached near its end to and between said first plate bracket members, the axis of rotation of said attachment being substantially perpendicular to the U-shaped plane of the link, said link and first mounting plate being pivotable between a first limit and a second limit;

(c) a second mounting plate also having a pair of bracket members, the second arm of said link being pivotally attached near its end to and between said second plate bracket members, the axis of rotation of said attachment being substantially perpendicular to the U-shaped plane of the link, said link and second plate being pivotable between a first limit and a second limit; and (d) means for increasing the inertial resistance between said first mounting plate and said link, partially restraining said first mounting plate and said link from being swung apart when they are at their first limit of pivot, said hinge including no such means for increasing the inertial resistance between said link and said second mounting plate.

2. The hinge of claim 1 wherein said first mounting plate includes a front surface and a rear surface, said bracket members being on said front surface, said rear surface being substantially parallel to the arms of said link when said link and said plate are at their first limit of pivot, and wherein said second limit of pivot is approximately 90° of arc away from said first limit, and wherein said second mounting plate also includes a front surface and a rear surface, said second plate's bracket members being on said front surface, said rear surface being substantially parallel to the arms of said link when said link and said second plate are at their first limit of pivot, and wherein said second limit of pivot is approximately 90° of arc away from said first limit.

3. The hinge of claim 2 wherein the means for increasing the inertial resistance is provided by a coil spring mounted around the axis of rotation of the first link arm, one end of said coil spring exerting torque against said first mounting plate, the other end of said coil spring exerting an opposite torque against said first link arm.

4. The hinge of claim 3 wherein the second limit of pivot of the second mounting plate is provided by the combination of (a) a protruding member carried either by one of the brackets of the second plate or by the second link arm and (b) a corresponding recess in the surface of the attached bracket or link arm, said recess being so located that said protruding member rides in said recess when the link and second plate are pivoted relative to each other said recess having an end wall which the protruding member abuts when the link and second mounting plate reach their second limit of pivot.

5. The hinge of claim 3 wherein the second limit of pivot of the second mounting plate is provided by the combination of (a) a protruding member carried by one of the brackets of the plate and (b) a corresponding recess in the surface of the second link arm, said recess being so located that said protruding member rides in said recess when the link and second plate are pivoted relative to each other said recess having an end wall which the protruding member abuts when the link and second mounting plate reach their second limit of pivot.

6. The hinge of claim 5 wherein the first mounting plate and the link are so dimensioned that the first arm of the link abuts the front surface of the first plate when the link and first plate are at their first limit of pivot.

7. The hinge of claim 6 wherein the second mounting plate and the link are so dimensioned that the second arm of the link abuts the front surface of the second plate when the link and second plate are at their first limit of pivot.

8. The hinge of claim 7 wherein each of the two mounting plates contains a first screw hole and a second screw hole, one on each bracket, the axis of each said hole being substantially perpendicular to the plate's rear surface.

9. The hinge of claim 8 including means for providing a second limit of pivot for the link and first mounting plate that is approximately 90° to 100° of arc away from their first limit of pivot.

10. The hinge of claim 9 wherein the second limit of pivot of the link and first plate is provided by the combination of (a) a protruding member carried either by one of the brackets of the first plate or by the first link arm and (b) a corresponding recess in the surface of the attached bracket or link arm, said recess being so located that said protruding member rides in said recess when the link and first plate are pivoted, said recess having an end wall which the protruding member abuts when the link and first plate reach their second limit of pivot.

11. The hinge of claim 9 wherein the second limit of pivot of the link and first plate is provided by the combination of (a) a protruding member carried by one of the brackets of the first mounting plate and (b) a corresponding recess in the surface of the first link arm, said recess being so located that said protruding member rides in said recess when the link and plate are pivoted, said recess having an end wall which the protruding member abuts when the link and first plate reach their second limit of pivot.

12. The hinge of claim 11 wherein the front surface of at least one of the two mounting plates includes a protruding stop member that abuts the front surface of the other mounting plate when both plates and the link are at their first limits of pivot.

13. The hinge of claim 12 wherein each link arm is thick enough that it touches both of the bracket members to which it is attached, and the portions of each link arm that ride against the bracket members are raised land areas.

14. The hinge of claim 5 wherein the protruding member carried by one of the brackets of the second mounting plate is a lug that is integral with said bracket.

15. The hinge of claim 8 wherein the front surface of each mounting plate includes a protruding stop member, said respective members being so positioned that they abut one another when both plates and the link are at their first limits of pivot.

16. The hinge of claim 8 wherein each link arm is thick enough that it touches both of the bracket members to which it is attached, and the portions of each link arm that ride against the bracket members are raised land areas.

17. The hinge of claim 11 wherein the protruding member carried by one of the brackets of the first mounting plate is a lug that is integral with said bracket.

18. The hinge of claim 11 wherein each link arm is thick enough that it touches both of the bracket members to which it is attached, and the portions of each link arm that ride against the bracket members are raised land areas.

19. The hinge of claim 2 wherein the restraining means are provided by the distance between the brackets on the first mounting plate being slightly less than the thickness of the first link arm, so that the link arm is force fit into the space between the brackets.

20. The hinge of claim 19 wherein the rear surface of the first mounting plate is slightly bowed inward toward the second mounting plate, with reference to the direction parallel to the axis of rotation of the link.

21. The hinge of claim 20 wherein the first mounting plate contains a first screw hole located between the plate's brackets, the axis of said hole being substantially perpendicular to the rear surface of the first mounting plate, and said screw hole being so located as to enable a straightening force to be applied to the bowed mounting plate by tightening a screw mounted in said hole.

22. The hinge of claim 21 wherein the second limit of pivot of the second mounting plate is provided by the combination of (a) a protruding member carried either by one of the brackets of the plate or by the second link arm and (b) a corresponding recess in the surface of the attached bracket or link arm, said recess being so located that said protruding member rides in said recess when the link and second plate are pivoted relative to each other said recess having an end wall which the protruding member abuts when the link and second mounting plate reach their second limit of pivot.

23. The hinge of claim 21 wherein the second limit of pivot of the second mounting plate is provided by the combination of (a) a protruding member carried by one of the brackets of the plate and (b) a corresponding recess in the surface of the second link arm, said recess being so located that said protruding member rides in said recess when the link and second plate are pivoted relative to each other said recess having an end wall which the protruding member abuts when the link and second mounting plate reach their second limit of pivot.

24. The hinge of claim 23 wherein the first mounting plate and the link are so dimensioned that the first arm of the link abuts the front surface of the first plate when the link and first plate are at their first limit of pivot.

25. The hinge of claim 24 wherein the second mounting plate and the link are so dimensioned that the second arm of the link abuts the front surface of the second plate when the link and second plate are at their first limit of pivot.

26. The hinge of claim 25 wherein each of the two mounting plates contains a second screw hole and a third screw hole, one on each bracket, the axis of each said hole being substantially perpendicular to the plate's rear surface.

27. The hinge of claim 26 including means for providing a second limit of pivot for the link and first mounting plate that is approximately 90° to 100° of arc away from their first limit of pivot.

28. The hinge of claim 27 wherein the second limit of pivot of the link and first plate is provided by the combination of (a) a protruding member carried either by one of the brackets of the first plate or by the first link arm and (b) a corresponding recess in the surface of the attached bracket or link arm, said recess being so located that said protruding member rides in said recess when the link and first plate are pivoted, said recess having an end wall which the protruding member abuts when the link and first plate reach their second limit of pivot.

29. The hinge of claim 27 wherein the second limit of pivot of the link and first plate is provided by the combination of (a) a protruding member carried by one of the brackets of the first mounting plate and (b) a corresponding recess in the surface of the first link arm, said recess being so located that said protruding member rides in said recess when the link and first plate are pivoted, said recess having an end wall which the protruding member abuts when the link and first plate reach their second limit of pivot.

30. The hinge of claim 29 wherein the front surface of at least one of the two mounting plates includes a protruding stop member that abuts the front surface of the other mounting plate when both plates and the link are at their first limits of pivot.

31. The hinge of claim 30 wherein each link arm is thick enough that it touches both of the bracket members to which it is attached, and the portions of each link arm that ride against the bracket members are raised land areas.

32. The hinge of claim 23 wherein the protruding member carried by one of the brackets of the second mounting plate is a lug that is integral with said bracket.

33. The hinge of claim 26 wherein the front surface of each mounting plate includes a protruding stop member, said respective members being so positioned that they abut one another when both plates and the link are at their first limits of pivot.

34. The hinge of claim 26 wherein each link arm is thick enough that it touches both of the bracket members to which it is attached, and the portions of each link arm that ride against the bracket members are raised land areas.

35. The hinge of claim 29 wherein the protruding member carried by one of the brackets of the first mounting plate is a lug that is integral with said bracket.

36. The hinge of claim 29 wherein each link arm is thick enough that it touches both of the bracket members to which it is attached, and the portions of each link arm that ride against the bracket members are raised land areas.

37. The hinge of claim 7 wherein said first mounting plate contains a first screw hole and a second screw hole, one on each bracket, the axis of each hole being substantially perpendicular to the plate's rear surface.

38. The hinge of claim 37 wherein said second mounting plate includes a means for attachment to a surface of said second member in such an orientation that said surface is substantially perpendicular to the rear surface of said second mounting plate.

39. The hinge of claim 38 wherein said attachment means comprises a threaded screw hole and a pin hole, both said holes being located on said second mounting plate so as to be at a level lower than that of the base of said link when said link and said second mounting plate are at their first limit of pivot, the axis of each said hole being substantially perpendicular to the second plate's rear surface.

40. The combination of a flat door with an edge, a flat stile with an edge, and at least two hinges mounting said door onto the edge of said stile in a position in which the flat surface of the door, when closed, forms a single unbroken plane with the flat surface of said stile, each said hinge comprising (a) a first and a second mounting plate, each said plate having a front surface and a rear surface, each said front surface containing a pair of bracket members, and each said rear surface being the surface which faces the door or the stile when the hinge is mounted, said first plate being mounted in a routed-out portion of the edge of the stile or door and said second plate being similarly mounted onto a routed-out portion of the edge of the stile or door opposite.

(b) a substantially U-shaped link having a base and two substantially parallel arms, the first arm of said link being pivotally attached near its end to and between said first plate bracket members, the second arm of said link being similarly attached to and between said second plate bracket members, the axis of rotation of each said attachment being substantially perpendicular to the U-shaped plane of the link and parallel to the rear surface of each said plate, said link and said mounting plates being pivotable between a first limit and a second limit that is at least 90° of arc away from said first limits, these limits provided by stop mechanisms in said link arms and said bracket members; and (c) a coil spring mounted around the axis of rotation of said first link arm, one end of said coil spring exerting torque against said first mounting plate, the other end of said coil spring exerting an opposite torque against said first link arm, said hinge having no such coil spring mounted between said second mounting plate and said second link arm.

41. The combination of a flat door with an edge, a flat stile with an edge, and at least two hinges mounting said door onto the edge of said stile in a position such that the plane of the flat surface of said door, when closed, forms a right angle with the plane of the flat surface of said stile, each said hinge comprising (a) a first and a second mounting plate, each having a front surface and a rear surface, each said front surface containing a pair of bracket members, said first plate being mounted in a routed-out portion of the edge of said door, said second plate being mounted in a routed-out portion of the edge of said stile, (b) a substantially U-shaped link having a base and two substantially parallel arms, the first arm of said link being pivotally attached near its end to and between said first plate bracket members, the second arm of said link being similarly attached to and between said second plate bracket members, the axis of rotation of each said attachment being substantially perpendicular to the U-shaped plane of the link and parallel to the rear surface of each said plate, said link and said mounting plates being relatively pivotable between a first limit and a second limit that is at least 90° of arc away from said first limits, these limits provided by stop mechanisms in said link arms and said bracket members; and (c) a coil spring mounted around the axis of rotation of said first link arm, one end of said coil spring exerting torque against said first mounting plate, the other end of said coil spring exerting an opposite torque against said first link arm, said hinge having no such coil spring mounted between said second mounting plate and said second link arm; and (d) a means for attaching said second mounting plate to a surface of said stile which is substantially perpendicular to the rear surface of said second mounting plate.

42. The combination of a table having a top with an edge, and a fold-up leaf having an edge, and at least two hinges mounting said leaf to the edge of said table-top, each said hinge comprising (a) a first and second mounting plate, each said plate having a front surface and a rear surface, each said front surface containing a pair of bracket members, and each said rear surface being the surface which faces the edge of said leaf or said table-top when the hinge is mounted, one said plate being mounted in a routed-out portion of the edge of said table-top or leaf, the other plate being similarly mounted in a routed-out portion of the edge of the table-top or leaf opposite, (b) a substantially U-shaped link having a base and two substantially parallel arms, the first arm of said link being pivotally attached near its end to and between said first plate bracket members, the second arm of said link being similarly attached to and between said second plate bracket members, the axis of rotation of each said attachment being substantially perpendicular to the U-shaped plane of the link and parallel to the rear surface of each said plate, said link and said mounting plates being relatively pivotable between a first limit and a second limit that is at least 90° of arc away from said first limits, these limits provided by stop mechanisms in said link arms and said bracket members; and (c) a coil spring mounted around the axis of rotation of said first link arm, one end of said coil spring exerting torque against said first mounting plate, the other end of said coil spring exerting an opposite torque against said first link arm, said hinge having no such coil spring mounted between said second mounting plate and said second link arm.

* * * * *